US009446579B2

(12) United States Patent
Tang et al.

(10) Patent No.: US 9,446,579 B2
(45) Date of Patent: Sep. 20, 2016

(54) METHOD FOR PRODUCING A PATTERNED STEEL PLATE BY USING ROLLER-COATING PRINTING AND SCREEN PRINTING

(71) Applicant: LIAONING CHAOSHUO TOMA TECHNOLOGY STEEL PLATE PRINTING CO., LTD., Yingkou, Liaoning (CN)

(72) Inventors: Yueping Tang, Yingkou (CN); Jianping Zhou, Yingkou (CN); Liang Wu, Yingkou (CN)

(73) Assignee: LIAONING CHAOSHUO TOMA TECHNOLOGY STEEL PLATE PRINTING CO., LTD., Yingkou (CN)

( * ) Notice: Subject to any disclaimer, the term of this patent is extended or adjusted under 35 U.S.C. 154(b) by 0 days.

(21) Appl. No.: 14/774,837

(22) PCT Filed: Jun. 28, 2013

(86) PCT No.: PCT/CN2013/078398

§ 371 (c)(1),
(2) Date: Oct. 27, 2015

(87) PCT Pub. No.: WO2014/139247

PCT Pub. Date: Sep. 18, 2014

(65) Prior Publication Data

US 2016/0052254 A1 Feb. 25, 2016

(30) Foreign Application Priority Data

Mar. 11, 2013 (CN) ..... 2013 1 0076149

(51) Int. Cl.
*B41F 15/12* (2006.01)
*B41M 1/12* (2006.01)
(Continued)

(52) U.S. Cl.
CPC ..... *B41F 15/0831* (2013.01); *B05D 1/28* (2013.01); *B41F 9/063* (2013.01); *B41F 15/20* (2013.01); *B41F 15/26* (2013.01); *B41F 19/00* (2013.01); *B41F 23/00* (2013.01); *B41F 33/00* (2013.01);
(Continued)

(58) Field of Classification Search
CPC ..... B41M 1/10; B41M 1/12; B41M 1/14; B41M 1/28; B41F 15/10; B41F 15/12; B41F 15/20; B41F 33/00; B41F 33/16; B05D 1/28
USPC ..... 101/129, 114
See application file for complete search history.

(56) References Cited

U.S. PATENT DOCUMENTS 1,999,413 A * 4/1935 Hemming ..... B44C 1/1756 156/237
RE25,134 E * 3/1962 Kinzelman ..... B41F 13/02 101/178
6,835,272 B1 * 12/2004 Lee ..... B41M 1/28 101/115

*Primary Examiner* — Leslie J Evanisko
(74) *Attorney, Agent, or Firm* — Oliff PLC

(57) ABSTRACT

The present provides a method for producing a patterned steel plate by using roller-coating printing and screen printing, and a ground color pattern produced can be more accurate and a thicker and solider printing layer with a stronger stereo perception can also be obtained by using the roller-coating printing and screen printing, meanwhile in roller coating section, a servo control system is further comprised to control the rotate speed of each roller of the roller coating equipment and the preset time, thus ensuring that the actual roller surface linear velocity is consistent with the process rotation speed, so there is no need to stop the line for adjusting in the production process, thus increasing the production efficiency.

15 Claims, 3 Drawing Sheets

(51) Int. Cl.

| | |
|---|---|
| ***B41F 15/08*** | (2006.01) |
| ***B41F 33/00*** | (2006.01) |
| ***B41M 1/10*** | (2006.01) |
| ***B41M 1/14*** | (2006.01) |
| ***B41M 1/28*** | (2006.01) |
| ***B05D 1/28*** | (2006.01) |
| ***B41F 23/00*** | (2006.01) |
| ***B41F 9/06*** | (2006.01) |
| ***B41F 15/20*** | (2006.01) |
| ***B41F 15/26*** | (2006.01) |
| ***B41F 19/00*** | (2006.01) |

(52) U.S. Cl.

CPC ..... *B41M 1/10* (2013.01); *B41M 1/12* (2013.01); *B41M 1/14* (2013.01); *B41M 1/28* (2013.01); *B41P 2215/50* (2013.01)

METHOD FOR PRODUCING A PATTERNED STEEL PLATE BY USING ROLLER-COATING PRINTING AND SCREEN PRINTING

FIELD OF INVENTION

The present invention relates to a method for producing a patterned steel plate by using roller-coating printing and screen printing, in particular, belonging to the field of patterned steel plate manufacturing.

BACKGROUND OF THE INVENTION

Screen printing, lithographic printing, letterpress printing and intaglio printing are together known as the four great printing methods. Screen printing is completed by using screen printing equipment which consist of five elements, such as screen printing forme, scraper, ink, printing table and substrate, wherein, mesh of image area and mesh of non-image area are arranged in the screen printing forme, and the ink is capable of penetrating through the mesh of image area, but not incapable of penetrating through the mesh of non-image area.

The basic printing process by using the screen printing equipment comprises the follow steps of providing ink to one side of a screen printing forme when printing, applying a certain pressure on a part of screen printing forme having ink thereon by using the scraper to make the ink move towards another side, so as to allow the ink to be extruded from the mesh of image area onto the substrate by the scraper during the movement, lifting the scraper after it scrapes the entire forme, so as to lift the screen printing forme and scrape the ink back to its initial position. And this is an entire process of printing a monochrome image or pattern. In the process, the ink mark stays within a certain area due to the stickiness of ink, thereby forming the same image as that of the image area.

In the screen printing process, when printing, the screen printing forme generates reaction force, which is a resilience force, to the scraper due to its tension resulting from the fact that a certain gap is kept between the screen printing forme and the substrate, and due to the effect of resilience, it make a linear contact between the screen printing forme and the substrate that move relative to each other, with the other part of the screen printing forme being separated from the substrate, thereby causing rhegmagenesis of the ink and the screen printing forme, therefore, the screen printing may have higher dimensional accuracy. Moreover, in screen printing, the ink is transferred onto the substrate through the mesh of image area by extrusion of scraper so as to form the same image as the original one, which has the advantages of simple structure of equipment, easy operation and low cost. At present, the screen printing has been widely applied in printing, and the common screen printing products comprise color painting, posters, business cards, binding cover, product tags, dyeing textile, etc.

Nowadays, the screen printing technology has already been successfully applied on steel plate in order to form a thicker and more solid printing layer with a stronger stereo perception. However, the printing accuracy of screen printing is lower than that of intaglio printing technology, and in order to obtain more accurate printing patterns and designs and ensure that veneer has a thick and solid printing layer with a stronger stereo perception, many existing manufacturers try to combine the screen printing and the intaglio printing together by using intaglio printing equipment to make roller coating ground color patterns and then using the screen printing technology to obtain a thick and solid printing layer.

The roller coating equipment of the prior art comprises a feeding equipment, used for providing paints; a suction roller, whose circumferential surface is in connection with the feeding equipment, and has a plurality of recesses adapted for being filled with paints for forming an image area; and a rubber coating roller, with its circumferential surface in connection with the suction roller, and used for receiving and transferring the image area formed by the paints on the coating roller onto a steel plate to form desired multicolored patterns.

However, during the process of using the roller coating equipment, the applicant found out that the roller surface linear velocity of the suction roller and the rubber coating roller are frequently inconsistent with the process speed of the whole production line, and the whole production line is lack of a control system for on-line adjusting the rotation speed of the suction roller and the rubber coating roller, so the whole production line has to be stopped for adjustment after operation for a period of time, thus affecting the efficiency of the whole production line. If the production line is not stopped for adjustment, the steel plate transporting speed would be inconsistent with the roller surface linear velocity of each roller, thus frequently causing the steel plate unable to be coated at a designated position thereof. Besides, in order to print multicolor patterns, a plurality of roller coating equipments are required for coordinated operation. However, the above mentioned roller coating equipments in the prior art are lack of a control system for allowing a continuous production between adjacent roller coating equipments, so workers need observe by human eyes if a first roller coating equipment has completed coating of one color, and if yes, an adjacent roller coating unit will be started by manual work, thus it is unable to realize a continuous production between the adjacent roller coating equipments. At the same time, due to lack of the control system for adjusting the rotate speed of the suction roller and the coating roller, it is unable to realize error revision when misplacement occurs between the patterns printed by the adjacent roller coating equipments.

In conclusion, when roller coating primer paint by using roller coating equipment introduced in the screen printing production line, how to adjust the roller surface linear velocity of each roller of roller coating equipment so as to allow the roller surface linear velocity of each roller to be consistent with the process speed, and further improve the production efficiency has become a technical problem that needs to be solved.

SUMMARY OF THE INVENTION

Therefore, a technical problem to be solved by the present invention is to provide a method of producing a patterned steel plate by using roller-coating printing and screen printing, which is able to adjust the rotation speed of each roller of roller coating equipment to be consistent with the rotation speed of the process, thus improving the production efficiency.

Thus, the present invention provides a method for producing a patterned steel plate by using roller-coating printing and screen printing, at least comprising in sequence the following process steps of A. preparing a steel strip to be printed;

B. using a first roller coating unit to perform a first roller coating transfer on the steel strip to be printed;

C. using a second roller coating unit to perform a second roller coating transfer on the steel strip after a preset time, thus producing a pattern with a specific ground color by the first roller coating transfer and the second roller coating transfer;

D. placing the steel strip having the pattern with a specific ground color formed thereon on a printing table and performing screen printing, so as to produce a pattern with a specific shape on the steel strip, wherein, in the step B, a servo control system is used to control the first roller coating unit, and the servo control system has a following control process of

S1. inputting data of diameter of each roller and a process speed of the first roller coating unit into a PLC control module, then calculating out theoretical roller surface linear velocity of each roller by the PLC control module according to the process speed and the diameter of each roller, allowing the theoretical roller surface linear velocity of each roller to be consistent with the process speed, and outputting a calculated theoretical roll surface linear velocity signal of each roller into a servo control module having an encoder;

S2. receiving the theoretical roll surface linear velocity signal of each roller by the servo control module from the PLC control module and driving each roller according to the theoretical roll surface linear velocity signal;

S3. collecting actual roller surface linear velocity of each roller by the encoder and outputting the actual roller surface linear velocity signal of each roller into the PLC control module;

S4. according to the received actual roller surface linear velocity signal and theoretical roller surface linear velocity signal of each roller, adjusting current frequency of electrical machine for driving each roller and adjusting the actual roller surface linear velocity of each roller to be consistent with the theoretical roller surface linear velocity of each roller by the PLC control module, thereby completing the roller coating transfer of the first roller coating unit.

In a class of embodiments, in the sub-step S1 of step B, data of distance between the first roller coating unit and the second roller coating unit is input into the PLC control module, and on the basis of the process speed and the data of distance, the PLC control module calculates out a time to start the second roller coating unit, and starts the second roller coating unit according to the time, and then the second roller coating transfer of the second roller coating unit is completed.

In a class of embodiments, after the sub-step S4 of step B, the printed patterns are collected by a code recognition module, and a pattern misplacement distance is determined by computer recognition, and then the process speed of the corresponding roller coating unit is revised.

In a class of embodiments, a flattening device is arranged at a bottom of the printing table, and before the screen printing of step D, flattens the surface of strip steel.

In a class of embodiments, the printing table is made of ferromagnetic material, and a magnet coil is arranged at a lower part of the printing table corresponding to a placement position of the strip steel and is connected with an energizing control device which is controlled to make the magnet coil energized when flattening so that the printing table is magnetized and the magnetized printing table attracts the strip steel and flattens the same.

In a class of embodiments, a plurality of through holes are arranged at the printing table corresponding to a placement position of the strip steel, and a fan is arranged at a bottom of the printing table and adapted for sucking air through the through holes when flattening, so as to form negative pressure in a clearance space formed by the strip steel and the printing table and the strip steel is further pressed towards the printing table, and the flattening is completed.

In a class of embodiments, the method further comprises a step of corona treatment on the strip steel prior to the step of first roller coating transfer.

In a class of embodiments, the method further comprises a step of electrostatic precipitation treatment between the corona treatment step and the first roller coating transfer step.

In a class of embodiments, in the step A, a decoiler is used to decoil and trim the steel strip and a seamer is used to seam the decoiled steel strip.

In a class of embodiments, the method further comprises a step of pre-processing the steel strip to be printed before transferring between the step A and the step of corona treatment, wherein, the pre-processing comprises in sequence the following steps of degreasing treatment, cleaning treatment, first drying treatment, passivating treatment and second drying treatment.

The method for producing a color steel plate with multi-colored patterns of present invention has advantages as below:

1. The method for producing a patterned steel plate by using roller-coating printing and screen printing of present invention, wherein a ground color pattern produced can be more accurate and a thick and solid printing layer with a stronger stereo perception can also be obtained by using the roller-coating printing and screen printing. for the first transfer, on one hand, the PLC control module of the servo control module collects the process speed and the rotation speed of each roller of the roller coating unit, calculates out the theoretical roller surface linear velocity and makes the theoretical roller surface linear velocity be consistent with the process rotation speed; on the other hand, the actual roller surface linear velocity of each roller of the roller coating unit is collected by a servo control module, and the signal of the actual roller surface linear velocity is input into the PLC control module, so that the PLC control module can compare the actual roller surface linear velocity with the theoretical roller surface linear velocity, and adjust current frequency until the actual roller surface linear velocity is consistent with the theoretical roller surface linear velocity. In the above mentioned control method, the actual roller surface linear velocity is adjusted to be consistent with the theoretical roller surface linear velocity which is consistent with the process speed, thus ensuring that the actual roller surface linear velocity is consistent with the process rotation speed, so there is no need to stop the line for adjusting in the production process, thus increasing the production efficiency.

2. The method for producing a patterned steel plate by using roller-coating printing and screen printing of present invention, further comprises a servo control system, and the data of distance between the first roller coating unit and the second roller coating unit is also input into the PLC control module, and on the basis of the process speed and the data of distance, the PLC control module is able to calculate out a time to start the second roller coating unit. Once the production line is determined, the distance between adjacent units can be determined. The data of distance is input into the PLC control module in advance, and then according to the process speed and data of distance, the PLC control module calculates out the time to start the next roller coating production line. Then the time for starting the next roller coating unit is able to be preset, and the next roller coating production line is allowed to be started within a preset time, so a continuous production between the adjacent roller coating units is realized, and the production efficiency is further improved.

3. The method for producing a patterned steel plate by using roller-coating printing and screen printing of present invention, further comprises a servo control system which further comprises a code recognition module. The printed patterns are collected by the code recognition module, and the pattern misplacement distance is determined by computer recognition, and then the process speed of the corresponding roller coating unit is revised. After the next roller coating production line is started and the second transfer is completed, the printed patterns are collected by the code recognition module and the pattern misplacement distance is determined by the computer recognition, and then the rotation speed of each roller is revised in accordance with the pattern misplacement distance, so that the pattern misplacement can be revised. The above process can be circularly performed, hence ensuring lifelike and complete printed patterns. In addition, the length of the printed patterns is extended significantly by using the code recognition module.

4. The method for producing a patterned steel plate by using roller-coating printing and screen printing of present invention, wherein a flattening device is arranged at a bottom of the printing table, and before the screen printing of step D, flattens the surface of strip steel, thereby the scraper can transfer ink by uniform force in the screen printing section, which reduce printing difficulties and makes it possible to apply the screen printing in the printed steel plate. The present invention provides a flattening method of Method 1 in detailed as follows: the printing table is made of ferromagnetic material, and a magnet coil is arranged at a lower part of the printing table corresponding to a placement position of the strip steel and is connected with an energizing control device which is controlled to make the magnet coil energized when flattening so that the printing table is magnetized and the magnetized printing table attracts the strip steel and flattens the same; Method 2, a plurality of through holes are arranged at the printing table corresponding to a placement position of the strip steel, and a fan is arranged at a bottom of the printing table and adapted for sucking air through the through holes, when flattening used this method, it will form a gap between the steel strip and the printing table due to unevenness, therefore, when the fan sucks air through the through holes, negative pressure area in a clearance space may be formed by the strip steel and the printing table, and the strip steel is further pressed towards the printing table, and the flattening is completed. The above two flattening devices have simple construction and are easy to operate.

5. The method for producing a patterned steel plate by using roller-coating printing and screen printing of present invention, further comprises a step of corona treatment on the strip steel prior to the step of first roller coating transfer and as a result that a plurality of pits are formed on the surface of the steel strip, which increases the surface roughness of the steel strip, thereby increasing adhesive force of the surface of the steel strip and the ink in order to make it difficult to appear a status of "paint loss" and improve the formability of the steel strip.

6. The method for producing a patterned steel plate by using roller-coating printing and screen printing of present invention, further comprising a step of electrostatic precipitation treatment between the corona treatment step and the first roller coating transfer step, thereby removing the "steel cuttings" of the surface face of steel strip during the process of corona treatment and increasing the surface purification.

BRIEF DESCRIPTION OF THE DRAWINGS

In order to make the present invention more easily and clearly understood, the invention is further described below in conjunction with the detailed embodiments and the drawings, wherein.

Figure 1:
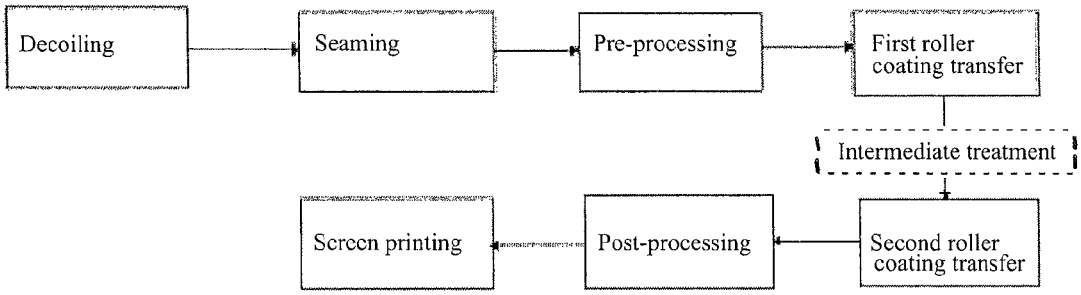
FIG. 1 is a flow chart of a method of producing a color steel plate with multicolored patterns printing of the present invention.

The reference numbers in the drawings represent:

1—feeding equipment; 2—suction roller; 3—rubber coating roller; 4—first scraper; 5—second scraper; 6—cleaning device; 61—liquid feed tank; 62—transfer pump; 63—transfer pipe; 64—spray pipe; 65—spray hole; 66—recovery tank; 67—recovery pipe; 68—filter; 7—support roller

DETAILED DESCRIPTION OF THE EMBODIMENTS

Embodiment 1

Figure 3:
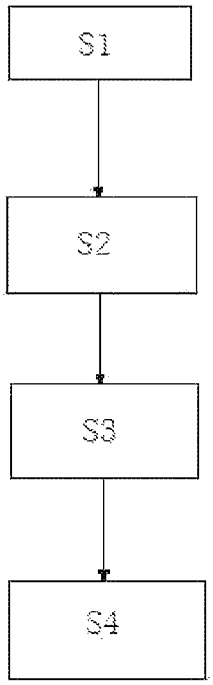
FIG. 3 is a workflow chart of a servo control system provided by the present invention.
Figure 4:
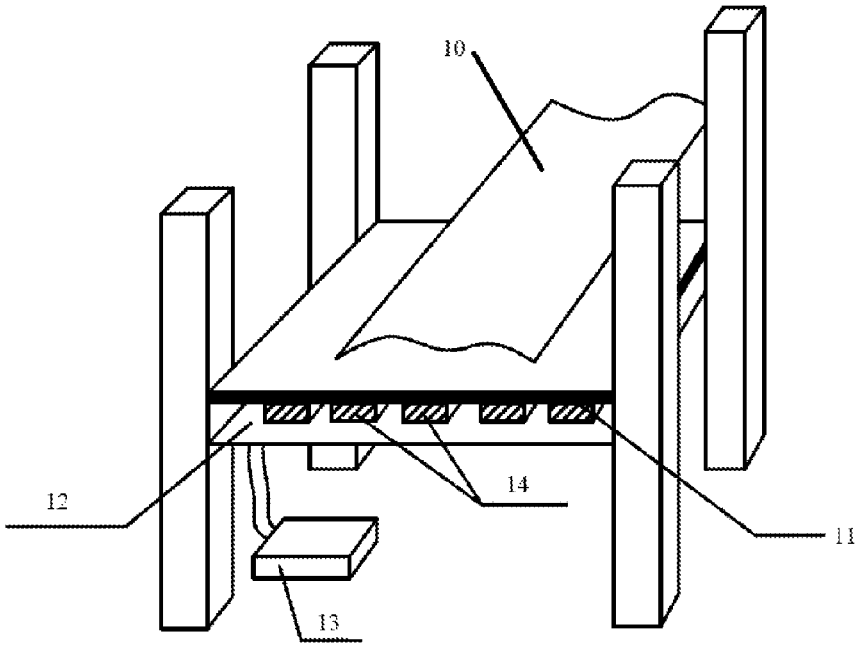
FIG. 4 shows an embodiment of the printing table.
Figure 5:
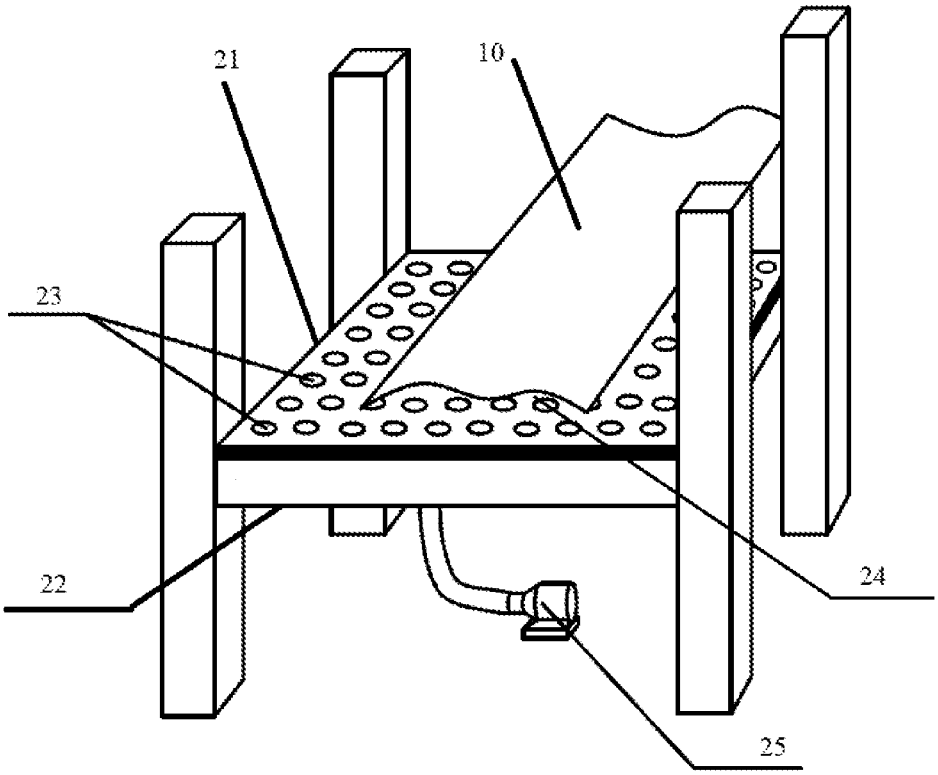
FIG. 5 shows another embodiment of the printing table.

As shown in FIG. 1, this embodiment provides a method of producing color steel plate with two-color patterns, comprising in sequence the following process steps of A. preparing a steel strip to be printed, wherein a decoiler is used to decoil and trim the steel strip and a seamer is used to seam the decoiled steel strip;

B. using a first roller coating unit to perform a first roller coating transfer on the steel strip to be printed;

C. using a second roller coating unit to perform a second roller coating transfer on the steel strip after a preset time, thus producing a pattern with a specific ground color by the first roller coating transfer and the second roller coating transfer;

D. placing the steel strip having the pattern with a specific ground color formed thereon on a printing table and performing screen printing, so as to produce a pattern with a specific shape on the steel strip;

in the step B, a servo control system is used to control the first roller coating unit, and the servo control system has a following control process as shown in FIG. 3:

S1. inputting data of diameter of each roller and a process speed of the first roller coating unit into a PLC control module, then calculating out theoretical roller surface linear velocity of each roller (the specific calculating method: theoretical rotation speed=process speed/$\pi$*diameter of each roller, theoretical roller surface linear velocity=theoretical rotation speed*roller diameter*$\pi$) by the PLC control module according to the process speed and the diameter of each roller, allowing the theoretical roller surface linear velocity of each roller to be consistent with the process speed, and outputting a calculated theoretical roll surface linear velocity signal of each roller into a servo control module having an encoder;

S2. receiving the theoretical roll surface linear velocity signal of each roller by the servo control module from the PLC control module and driving each roller according to the theoretical roll surface linear velocity signal;

S3. collecting actual roller surface linear velocity of each roller by the encoder and outputting the actual roller surface linear velocity signal of each roller into the PLC control module;

S4. according to the received actual roller surface linear velocity signal and theoretical roller surface linear velocity signal of each roller, adjusting current frequency of electrical machine for driving each roller and adjusting the actual roller surface linear velocity of each roller to be consistent with the theoretical roller surface linear velocity of each roller by the PLC control module, thereby completing the roller coating transfer of the first roller coating unit.

In the present embodiment, in order to realize continuous operation of adjacent roller coating units on line, in the sub-step S1, data of distance between the first roller coating unit and the second roller coating unit is input into the PLC control module, and on the basis of the process speed and the data of distance, the PLC control module calculates out a time to start the second roller coating unit, and starts the second roller coating unit according to the time, and then the second roller coating transfer of the second roller coating unit is completed.

In the present embodiment, in order to print irregular long patterns, after completing the printing of the second roller coating unit, that is, after the step S4, the printed patterns are collected by a code recognition module, and a pattern misplacement distance is determined by a computer recognition system, and then the process speed of the corresponding roller coating unit is revised. The revision process is described in detail as below. If the actual position of a latter printed color in the patterns collected by the code recognition module misplaces a distance from the predetermined position of the latter printed color relative to the former printed color, for example, the actual position locates at 10 mm ahead of the predetermined position, which indicates that the actual process speed (denoted by V1) of the roller delivering the steel strip speeds up 10 mm per unit time relative to the theoretical process speed (denoted by V2), that is at this time, $V2=V1-10$, thus calculating out V2. Then the calculated V2 is converted into the theoretical rotation speed of the roller (denoted by N) via the formula $N=V2/\pi*$roller diameter, thereby adjusting the current frequency of the corresponding electric machine in accordance with rotation speed N, thus the rotation speed of the corresponding roller will be adjusted, and the process speed will be further adjusted, and finally the pattern misplacement accuracy is controlled within ±0.6 millimeter. This adjusting process is a dynamic and repeated process. Herein, the printed patterns are collected by a digital video comprised in the code recognition module.

In the present embodiment, as the flattening device 12 is arranged at a bottom of the printing table, and the flattening device 12, 22 is able to flatten the strip steel 10 that is cold rolled and/or hot rolled and further is shaped by being sheared, so as to allow the scraper to perform ink coating transfer under a uniform force, which reduces the difficulty of screen printing. Since the flattening device 12 is arranged at the bottom of the printing table 11, before the screen printing of step D, the flattening device 12 is used to flatten the strip steel 10. The process of flattening is provided in detail as follows: the printing table 11 is made of ferromagnetic material, and a magnet coil 14 is arranged at a lower part of the printing table 11 corresponding to a placement position of the strip steel 10 and is connected with an energizing control device 13 which is controlled to make the magnet coil 14 energized when flattening so that the printing table 11 is magnetized and the magnetized printing table 11 attracts the strip steel 10 and flattens the same.

In order to improve the formability of the printed steel strip, the present embodiment preferably comprises a step of pre-processing the steel strip to be printed before transferring between the step A and step B, and the pre-processing before transferring comprises in sequence the following steps of in the degreasing treatment, an alkali liquor with an concentration of 1% and an the degreasing is performed at the temperature of 50-65 degrees so as to remove oil and dust from the surface of the strip steel, and in the alkali liquor, the ratio of total alkali to free alkali is less than 2.5; in the cleaning treatment, desalted water having a temperature of 50-65 degrees and a PH value less than 7.8 is used to wash the surface of the strip steel after degreasing treatment, so as to remove residual alkali liquor on surface of the strip steel; in a first drying treatment, hot air having a temperature of 75-85 degrees heated by a vapor heat exchanger is used to dry the surface of the strip steel after cleaning so as to remove residual water thereon; in the passivating treatment, the surface of the strip steel after cleaning is passivated with a treating solution having Chromium weight of 22-32, so as to increase the adhesion force between the strip steel and the primer paint and also increase the antiseptic property; in a second drying treatment, the passivated surface is dried by an electrical heating oven at a baking temperature of 75-85 degrees, in order to enhance passivation effect. In the coating primer paint treatment, the first roller coating unit is used to coat primer paint and back paint on the surface of the strip steel, and the color and the property of the primer paint depend on the patterns to be printed; in the baking for curing treatment and first cooling treatment, the strip steel coated with the primer paint and the back paint is baked to allow the primer paint and the back paint to be fully dried at temperature of 214-232 degrees, then the strip steel is cooled by water spay and flow to further stabilize the property of the primer paint and the back paint.

In the present embodiment, in order to improve brightness of the ground-color patterns and protection for the same, a post processing treatment is performed to the steel strip in the step C, and the post processing treatment comprises steps of spraying gloss paint on the surface of the steel strip, and then performing a third drying treatment, followed by a second cooling treatment.

In the present embodiment, in order to let the produced steel strip be convenient for storage and transport, a recoiler is used to coil the steel strip after completing all the roller coating transfer.

In the present embodiment, after the first roller coating transfer and after the first roller coating transfer, it further comprises a step of intermediate treatment which is drying and cooling treatment, and it should be noted that, the intermediate treatment should be ensured to complete before starting the second roller coating unit, alternatively, the time of performing the intermediate treatment is taken into consideration when calculating out the specific time to start the second roller coating unit, thereby revising the starting time of the second roller coating unit.

It should be noted that, for the production method of the above color steel plate with multicolored patterns of the present invention, roller coating units are required for carrying out the step B and the step C, but there is no limitation to the specific structure of the roller coating units.

It should be noted that, the present embodiment provides a method for producing a color steel plate with two colored patterns, which requires two roller coating units. While on the basis of the production method of the present embodiment, in particular of the technology for adjusting rotation speed, time for starting the second roller coating unit, and the code recognition in the servo control system, modifications can be made by those skilled in the art so as to produce color steel plate with patterns in three-, four-, five- or more colors.

Embodiment 2

This embodiment provides a method for producing a patterned steel plate by using roller-coating printing and screen printing, and the method is a variation of production method of embodiment 1, in which the flattening method of the steel strip is different from embodiment 1. In the present embodiment, the detailed flattening method of the steel strip is introduced as follows: a plurality of through holes 23 are arranged at the printing table 21 corresponding to a placement position of the strip steel 10, and a fan 25 is arranged at a bottom of the printing table 21 and adapted for sucking air through the through holes 23 when flattening, so as to form negative pressure in a clearance space 24 formed by the strip steel 10 and the printing table 21, and the strip steel 10 is further pressed towards the printing table 21, and the flattening is completed.

Embodiment 3

Figure 2:
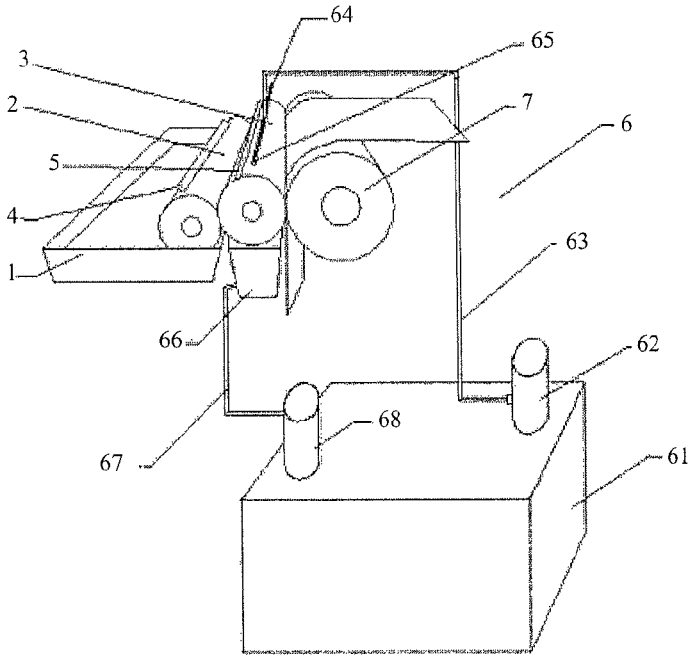
FIG. 2 is a schematic view of a roller coating unit of the present invention.

The present embodiment provides a structure of the roller coating unit used in the steps B and C in the embodiment 1 and embodiment 1. As shown in FIG. 2, the roller coating unit comprises a feeding equipment 1 used for providing paints; a suction roller 2, whose circumferential surface is in connection with the feeding equipment 1, and has a plurality of recesses adapted for being filled with paints for forming an image area; a rubber-coating roller 3, with its circumferential surface in connection with the suction roller 2, used for receiving and transferring the image area formed by the paints on the coating roller 3 onto a steel plate; a first scraper 4, arranged on a first scraper support and contacting with the suction roller 2 at a specific angle, used for scraping off paints outside the image area on the suction roller 2; and a second scraper 5, arranged on the second scraper support and contacting with the coating roller 3 at a specific angle, used for scraping off paints outside the image area on the rubber coating roller 3.

The working process of the roller coating unit in the present embodiment is described as below. The suction roller 2 runs, and the feeding equipment 1 supplies the suction roller 2 with paints. A part of the paints gets into the recesses used for forming an image area on the suction roller 2, and another part of the paints locates outside the recesses on the suction roller 2. The paints outside the recesses on the suction roller 2 is scraped off by the first scraper 4, then the suction roller 2 rotates to transfer the paints in the recesses onto the rubber-coating roller 3 to form an image area. Then the paints outside the image area on the rubber coating roller 3 is scraped off by the second scraper, then the rubber coating roller 3 rotates to transfer the image area onto the metal plate to be printed to form a pattern. The metal plate to be printed is supported by a support roller 7 which also provides a supporting force for the coating operation of the rubber coating roller.

The method for producing a patterned steel plate by using the roller coating units of the present embodiment is introduced as follows:

A. preparing a steel strip to be printed, wherein a decoiler is used to decoil and trim the steel strip and a seamer is used to seam the decoiled steel strip;

B. using a first roller coating unit to perform a first roller coating transfer on the steel strip to be printed;

C. using a second roller coating unit to perform a second roller coating transfer on the steel strip after a preset time, thus producing a pattern with a specific ground color by the first roller coating transfer and the second roller coating transfer;

D. placing the steel strip having the pattern with a specific ground color formed thereon on a printing table and performing screen printing, so as to produce a pattern with a specific shape on the steel strip;

in the step B, a servo control system is used to control the first roller coating unit, and the servo control system has the following control process:

S1. inputting data of diameter of the suction roller 2 and the coating roller 3 and the process speed of the first roller coating unit into a PLC control module, then calculating out theoretical roller surface linear velocity of the suction roller 2 and the coating roller 3 by the PLC control module according to the process speed and the diameter of the suction roller 2 and the coating roller 3, allowing the theoretical roller surface linear velocity of the suction roller 2 and the coating roller 3 to be consistent with the process speed, and outputting a calculated theoretical roller surface linear velocity signal of the suction roller 2 into a first servo control module having a first encoder, and outputs the theoretical roller surface linear velocity signal of the coating roller 3 into a second servo control module having a second encoder;

S2. receiving the theoretical roller surface linear velocity signal of the suction roller 2 by the first servo control module from the PLC control module and according to the signal, driving the suction roller 2; receiving the theoretical roller surface linear velocity signal of the coating roller 3 by the second servo control module from the PLC control module and according to the signal, driving the coating roller 3;

S3. collecting the actual roller surface linear velocity of the suction roller 2 by the first encoder and outputting the actual roller surface linear velocity signal of the suction roller 2 into the PLC control module, and collecting the actual roller surface linear velocity of the coating roller 3 by the first encoder and outputting the actual roller surface linear velocity signal of the coating roller 3 into the PLC control module;

S4. according to the received actual roller surface linear velocity signal and the theoretical roller surface linear velocity signal of the suction roller 2 and the coating roller 3, adjusting current frequency of electrical machine and adjusting the actual roller surface linear velocity of the suction roller 2 and the coating roller 3 to be consistent with the theoretical roller surface linear velocity of the suction roller 2 and the coating roller 3 by the PLC control module, thereby completing the roller coating transfer of the first roller coating unit.

The rubber coating roller 3 of the roller coating unit of the present embodiment is made of rubber, and such a design of structure allows the rubber coating roller to flexibly contact with the suction roller 2 and the steel plate to be printed respectively, thus ensuring an exactly matching contact. In this way, the image area on the suction roller 2 can be completely transferred onto the rubber coating roller 3, and the image area on the rubber coating roller 3 can be completely transferred onto the steel plate to be printed, thus forming a complete image area. Moreover, the intaglio printing machine provided in the present embodiment comprises a first scraper 4 and a second scraper 5 (FIG. 1 is a schematic diagram showing the first scraper 4 in contact with the suction roller 2 and the second scraper 5 in contact with the rubber coating roller 3). The first scraper 4 is used to scrape off the paints outside the recesses on the suction roller 2, and the second scraper 5 is used to scrape off the paints outside the image area on the rubber coating roller 3, thus avoiding the defect of lower labor efficiency caused by manual scrape, thereby improving labor efficiency. In addition, the first scraper 4 and the second scraper 5 are contacting with the suction roller 2 and the rubber coating roller 3 at a specific angle respectively, which can ensure better effect of scraping and prolonging the service life of the scraper.

It should be noted that, the coating roller may also be made of other materials as well as rubber, as long as the materials can ensure normal coating and flexible contact with the suction roller and the steel plate to be printed, such as silicone products which can meet requirements for elasticity, hardness and transfer property during coating.

In the present embodiment, the first scraper 4 contacts with the suction roller 2 at an angle less than 30 degrees, and the second scraper 5 contacts with the coating roller 3 at an angle more than 30 degrees. During intaglio printing process, paints that need to be scraped off are located on different positions at a same moment, so the first scraper 4 and the second scraper 5 are set at different angles, thus ensuring paints on the suction roller 2 and the coating roller 3 can be scraped off at the same time.

In the present embodiment, the first scraper 4 is made from titanium steel plate and has a blade thickness of 0.3 mm, and the second scraper 5 is made from titanium steel plate and has a blade thickness of 0.3 mm.

In the present embodiment, in order to improve the properties of the roller coating unit, a cleaning device 6 is provided for cleaning the paints on second scraper 5 and the rubber coating roller 3. The cleaning device 6 comprises a liquid feed tank 61, a transfer pump 62 used for pumping the cleaning liquid in the liquid feed tank 61, a cleaning liquid transfer pipe 63 communicated with the cleaning liquid transfer pump 62, and a spay pipe 64 communicated with the cleaning liquid transfer pipe. The spay pipe 64 is arranged above the rubber coating roller 3 in the axial direction and has a plurality of spay holes 65 thereon. The cleaning device 6 further comprises a cleaning liquid recovery tank 66, arranged below the coating roller 3 and connected with a recovery pipe 67 leading to the liquid feed tank 61. A filter 68 is arranged between the recovery pipe 67 and the liquid feed tank 61.

The working process of the cleaning device 6 provided in the present embodiment is described as below:

The cleaning liquid in the liquid feed tank 61 is pumped to the spay pipe 64 by the transfer pump 62, and is sprayed through the spray holes 65, subsequently the cleaning liquid flows over the rubber coating roller 3 and flows into the recovery tank 66, then passes through the recovery pipe 67 and is filtered by the filter 68, and finally gets back to the liquid feed tank 61 for recycling.

In the present embodiment, the feeding equipment 1 is a tray with a groove.

While particular embodiments of the invention have been shown and described, it will be obvious to those skilled in the art that changes and modifications may be made without departing from the invention in its broader aspects, and therefore, the aim of the appended claims is to cover all such changes and modifications as fall within the true spirit and scope of the invention.

The invention claimed is:

1. A method for producing a patterned steel plate by using roller-coating printing and screen printing, at least comprising in sequence the following process steps of A. preparing a steel strip to be printed;

B. using a first roller coating unit to perform a first roller coating transfer on the steel strip to be printed;

C. using a second roller coating unit to perform a second roller coating transfer on the steel strip after a preset time, thus producing a pattern with a specific ground color by the first roller coating transfer and the second roller coating transfer;

D. placing the steel strip having the pattern with a specific ground color formed thereon on a printing table and performing screen printing, so as to produce a pattern with a specific shape on the steel strip, wherein, in the step B, a servo control system is used to control the first roller coating unit, and the servo control system has a following control process of S1. inputting data of diameter of each roller and a process speed of the first roller coating unit into a PLC control module, then calculating out theoretical roller surface linear velocity of each roller by the PLC control module according to the process speed and the diameter of each roller, adjusting the theoretical roller surface linear velocity of each roller to be equal to the process speed, and outputting a calculated theoretical roll surface linear velocity signal of each roller into a servo control module having an encoder;

S2. receiving the theoretical roll surface linear velocity signal of each roller by the servo control module from the PLC control module and driving each roller according to the theoretical roll surface linear velocity signal;

S3. collecting actual roller surface linear velocity of each roller by the encoder and outputting the actual roller surface linear velocity signal of each roller into the PLC control module;

S4. according to the received actual roller surface linear velocity signal and theoretical roller surface linear velocity signal of each roller, adjusting current frequency of electrical machine for driving each roller and adjusting the actual roller surface linear velocity of each roller to be consistent with the theoretical roller surface linear velocity of each roller by the PLC control module, thereby completing the roller coating transfer of the first roller coating unit;

before the screen printing of step D, flattening a surface of the strip steel by using a flattening device arranged at a bottom of the printing table;

wherein, the flattening process comprising the steps of energizing a magnet coil arranged at a lower part of the printing table corresponding to a placement position of the strip steel by controlling an energizing control device connected with the magnet coil, and magnetizing the printing table made of ferromagnetic material, attaching and flattening the strip steel by the printing table; or comprising the steps of using a fan arranged at the bottom of the printing table to such air through a plurality of through holes arranged at the printing table corresponding to a placement position of the strip steel, forming a negative pressure in a clearance space formed by the strip steel and the printing table, further pressing the strip steel towards the printing table, and completing the flattening.

2. The method of claim 1, wherein, in the sub-step S1 of step B, data of distance between the first roller coating unit and the second roller coating unit is input into the PLC control module, and on the basis of the process speed and the data of distance, the PLC control module calculates out a time to start the second roller coating unit, and starts the second roller coating unit according to the time, and then the second roller coating transfer of the second roller coating unit is completed.

3. The method of claim 2, wherein, after the sub-step S4 of step B, the printed patterns are collected by a code recognition module, and a pattern misplacement distance is determined by computer recognition, and then the process speed of the corresponding roller coating unit is revised.

4. The method of claim 3, wherein, further comprising a step of corona treatment on the strip steel prior to the step of first roller coating transfer.

5. The method of claim 4, wherein, further comprising a step of electrostatic precipitation treatment between the corona treatment step and the first roller coating transfer step.

6. The method of claim 5, wherein, in the step A, a decoiler is used to decoil and trim the steel strip and a seamer is used to seam the decoiled steel strip.

7. The method of claim 6, further comprising a step of pre-processing the steel strip to be printed before transferring between the step A and the step of corona treatment, wherein, the pre-processing comprises in sequence the following steps of degreasing treatment, cleaning treatment, first drying treatment, passivating treatment and second drying treatment.

8. The method of claim 2, wherein, further comprising a step of corona treatment on the strip steel prior to the step of first roller coating transfer.

9. The method of claim 8, wherein, further comprising a step of electrostatic precipitation treatment between the corona treatment step and the first roller coating transfer step.

10. The method of claim 9, wherein, in the step A, a decoiler is used to decoil and trim the steel strip and a seamer is used to seam the decoiled steel strip.

11. The method of claim 10, further comprising a step of pre-processing the steel strip to be printed before transferring between the step A and the step of corona treatment, wherein, the pre-processing comprises in sequence the following steps of degreasing treatment, cleaning treatment, first drying treatment, passivating treatment and second drying treatment.

12. The method of claim 1, wherein, further comprising a step of corona treatment on the strip steel prior to the step of first roller coating transfer.

13. The method of claim 12, wherein, further comprising a step of electrostatic precipitation treatment between the corona treatment step and the first roller coating transfer step.

14. The method of claim 13, wherein, in the step A, a decoiler is used to decoil and trim the steel strip and a seamer is used to seam the decoiled steel strip.

15. The method of claim 14, further comprising a step of pre-processing the steel strip to be printed before transferring between the step A and the step of corona treatment, wherein, the pre-processing comprises in sequence the following steps of degreasing treatment, cleaning treatment, first drying treatment, passivating treatment and second drying treatment.

* * * * *